US010224609B2

(12) United States Patent
Li et al.

(10) Patent No.: US 10,224,609 B2
(45) **Date of Patent: *Mar. 5, 2019**

(54) ANTENNA USING CONDUCTOR AND ELECTRONIC DEVICE THEREFOR

(71) Applicant: AAC Technologies Pte. Ltd., Singapore OT (SG)

(72) Inventors: ShuMing Li, Shenzhen (CN); YueHua Yue, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 136 days.

This patent is subject to a terminal disclaimer.

(21) Appl. No.: 15/416,225

(22) Filed: Jan. 26, 2017

(65) Prior Publication Data

US 2017/0346160 A1 Nov. 30, 2017

(30) Foreign Application Priority Data

May 27, 2016 (CN) ..... 2016 2 0497241 U

(51) Int. Cl.
*H01Q 1/24* (2006.01)
*H01Q 1/40* (2006.01)

(52) U.S. Cl.
CPC ..... *H01Q 1/243* (2013.01); *H01Q 1/40* (2013.01)

(58) Field of Classification Search
CPC .... H01Q 1/2258; H01Q 1/2266; H01Q 1/243; H01Q 1/40
See application file for complete search history.

(56) References Cited

U.S. PATENT DOCUMENTS

2014/0333488 A1* 11/2014 Wang ..... H01Q 1/243 343/702
2017/0033436 A1* 2/2017 Yan ..... H01Q 1/243

* cited by examiner

*Primary Examiner* — Robert Karacsony
(74) *Attorney, Agent, or Firm* — Na Xu; IPro, PLLC

(57) ABSTRACT

The present disclosure provides an antenna device. The antenna device includes a metal housing having accommodating space and a LDS antenna accommodated in the metal hosing, the metal housing includes a metal shell, a metal cover and a metal ring which cooperate and are spaced with each other, inner wall surfaces of the metal shell, the metal cover and the metal ring are respectively provided with an adhesive coated layer, the LDS antenna is laser etched on a surface of the adhesive coated layer and is coupled with the metal cover. The antenna device of the present disclosure avoids frequency offset caused by gap size difference due to assembling errors between coupled antennas, so that the coupled antennas show better performance and consistency.

9 Claims, 9 Drawing Sheets

ANTENNA USING CONDUCTOR AND ELECTRONIC DEVICE THEREFOR

TECHNICAL FIELD

The present disclosure relates to the field of mobile communication technologies and, in particular, to an antenna device and a mobile terminal.

BACKGROUND

With the development of mobile communication technologies, electronic products such as cellphone, PAD, laptop etc. have become a necessity in people's life, and such electronic products are provided with an antenna system so that they become electronic communication products having communication functions.

An laser direct structuring (Laser Direct Structuring, LDS) antenna in the related art is generally installed into a speaker box. However, the size of a gap between the speaker box and a metal back cover which serves as an antenna radiator of a cellphone is difficult to be controlled within 0.1 mm. Moreover, coupled antennas are sensitive to the gap size between antennas, tiny difference in the gap size may result in dozens or hundreds MHz of frequency offset, which may lead to significant frequency offset difference between antennas, thereby restricting the application of coupled antenna in the cellphone.

Therefore, there is a necessity to provide a new antenna device so as to solve the above problem.

DESCRIPTION OF EMBODIMENTS

The present disclosure will be further illustrated with reference to the accompanying drawings and the embodiments.

Figure 1:
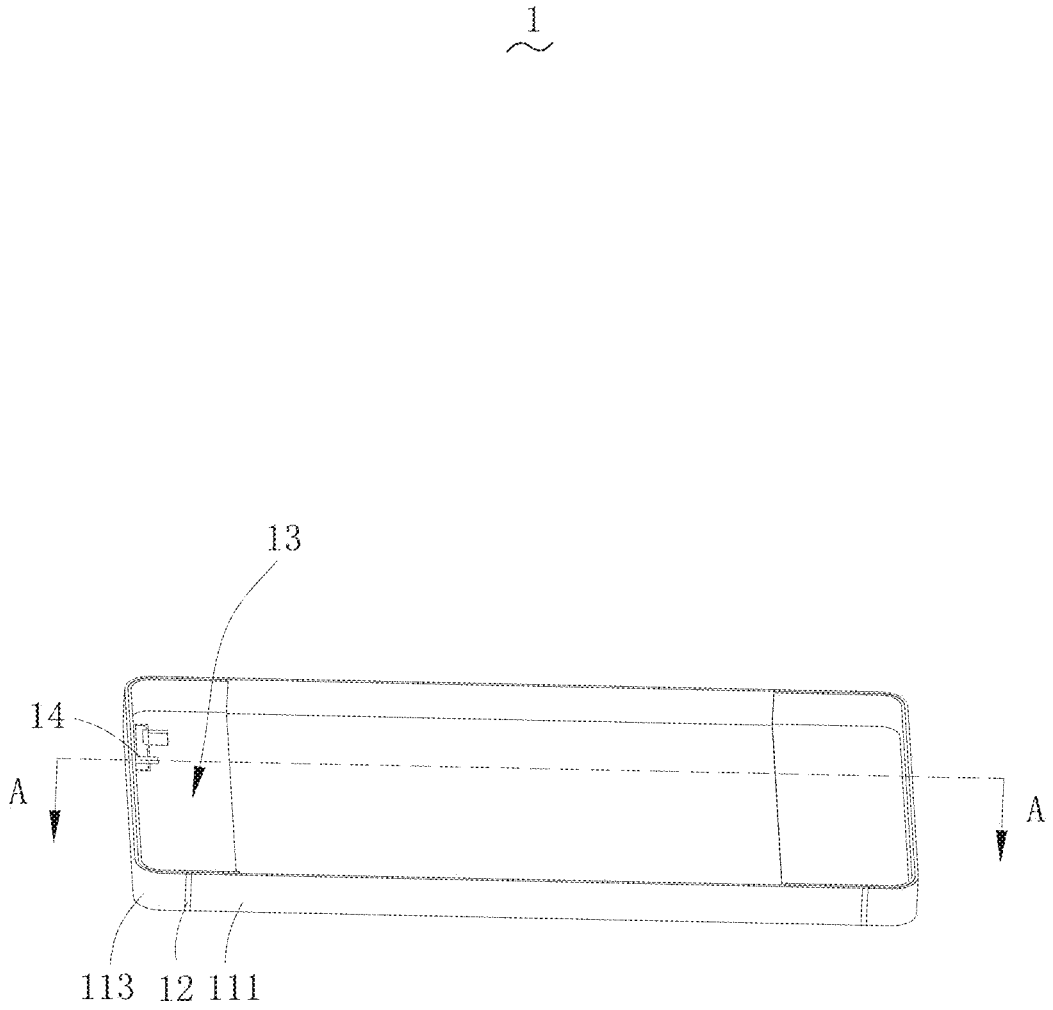
FIG. 1 is a perspective structural schematic view of an antenna device in accordance with the present disclosure.
Figure 2:
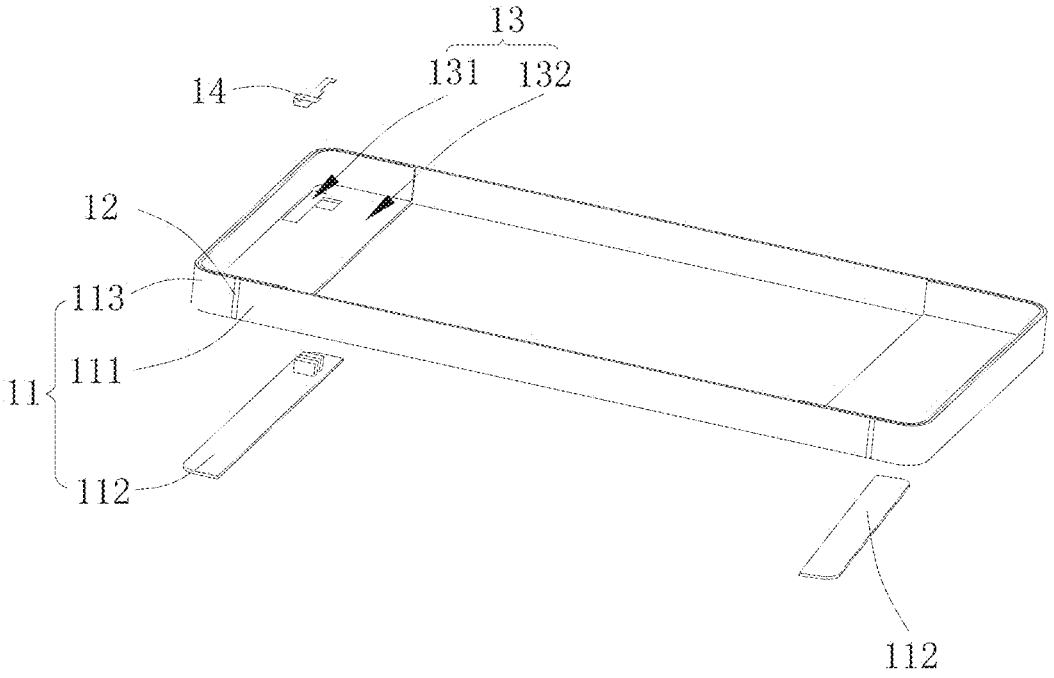
FIG. 2 is a perspective structural exploded view of the antenna device shown in FIG. 1.

Please refer to FIG. 1 and FIG. 2, FIG. 1 is a perspective structural schematic view of an antenna device in accordance with the present disclosure; FIG. 2 is a perspective structural exploded view of the antenna device shown in FIG. 1. The antenna device 1 includes a metal housing 11 having accommodating space, a connecting piece 12, an adhesive coated layer 13 provided on an inner wall of the metal housing 11 and an LDS antenna 14 accommodated in the metal housing 11.

The metal housing 11 includes a metal shell 111, a metal cover 112 and a metal ring 113 which cooperate with and are spaced with each other. The metal shell 111, the metal cover 112 and the metal ring 113 are connected via the connecting piece 12.

The adhesive coated layer 13 is provided on inner wall surfaces of the metal shell 111, the metal cover 112 and the metal ring 113. The adhesive coated layer 13 is combined to the metal housing 11 and the connecting piece 12 through inject molding, the connecting piece 12 and the adhesive coated layer 13 are integrated as a whole, the connecting piece 12 is formed by inject molding using a same material as that of the adhesive coated layer 13. The material for injection molding is polybutylene terephthalate (PBT), that is, the adhesive coated layer is a PBT layer. The inner walls of the metal shell 111, the metal cover 112 and the metal ring 113 are combined with PBT material through nano inject molding so as to form a plastic laser etching material which can be laser etched, that is, the adhesive coated layer 13 after inject molded can be laser etched, so as to facilitate laser etching processing.

Figure 3:
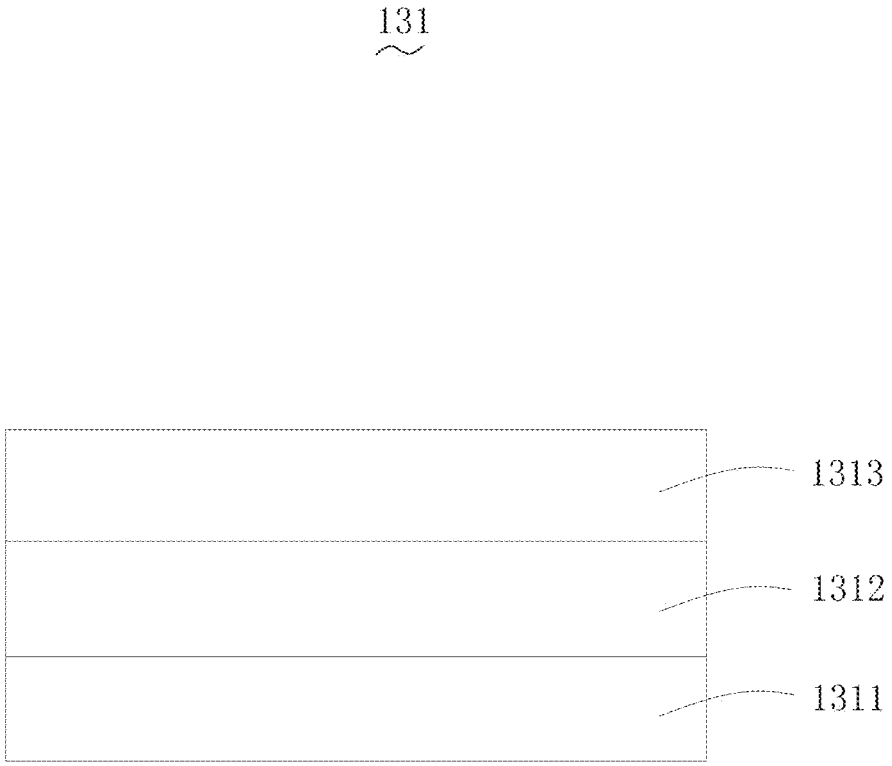
FIG. 3 is a structural schematic view of a modified region of an adhesive coated layer shown in FIG. 1.

Please refer to FIG. 3, which is a structural schematic view of a modified region of an adhesive coated layer shown in FIG. 1. The adhesive coated layer 13 includes a modified region 131 and a non-modified region 132 which surrounds a periphery of the modified region 131, the modified region 131 includes a surface processing layer 1311, a laser etching layer 1312 and a metal layer 1313 which are successively formed, the metal layer 1313 covers the surface of the laser etching layer 1312, the laser etching layer 1312 is formed on the surface processing layer 1311. The metal housing 11 is inject molded with PBT so as to form the adhesive coated layer 13 which can be laser etched, and the modified region 131 is processed with special surface processing so that it is modified to be capable of being laser etched, and then forms the surface processing layer 1311. The surface processing layer 1311 is laser etched to form the laser etching layer 1312 which covers the surface processing layer 1311, so that the metallic compound in the metal-containing plastic can be separated, the exposed metal atoms provide a seed layer for the following chemical plating process, which is then chemically plated to form a metal layer 1313 on the laser etching layer 1312 formed by laser etching. Through surface processing to the PBT material, the PBT material is modified to be capable of being laser etched and chemically plated, so that the antenna is more flexible, thereby particularly broadening the application range of the coupled antenna in antennas which are sensitive to the size of the surrounding environment.

Figure 4:
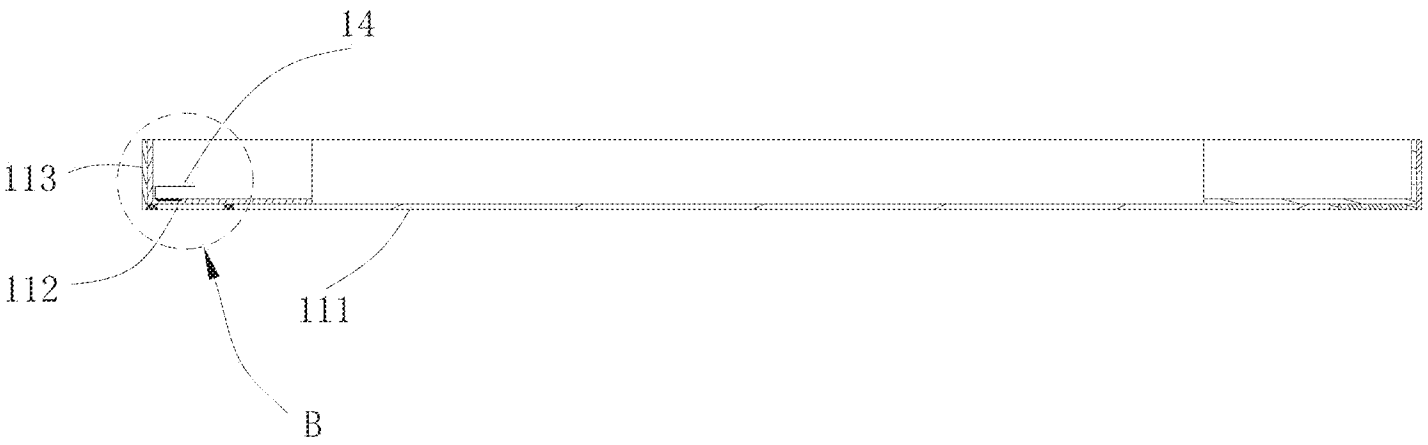
FIG. 4 is a structural schematic view of a section along A-A line shown in FIG. 1.
Figure 5:
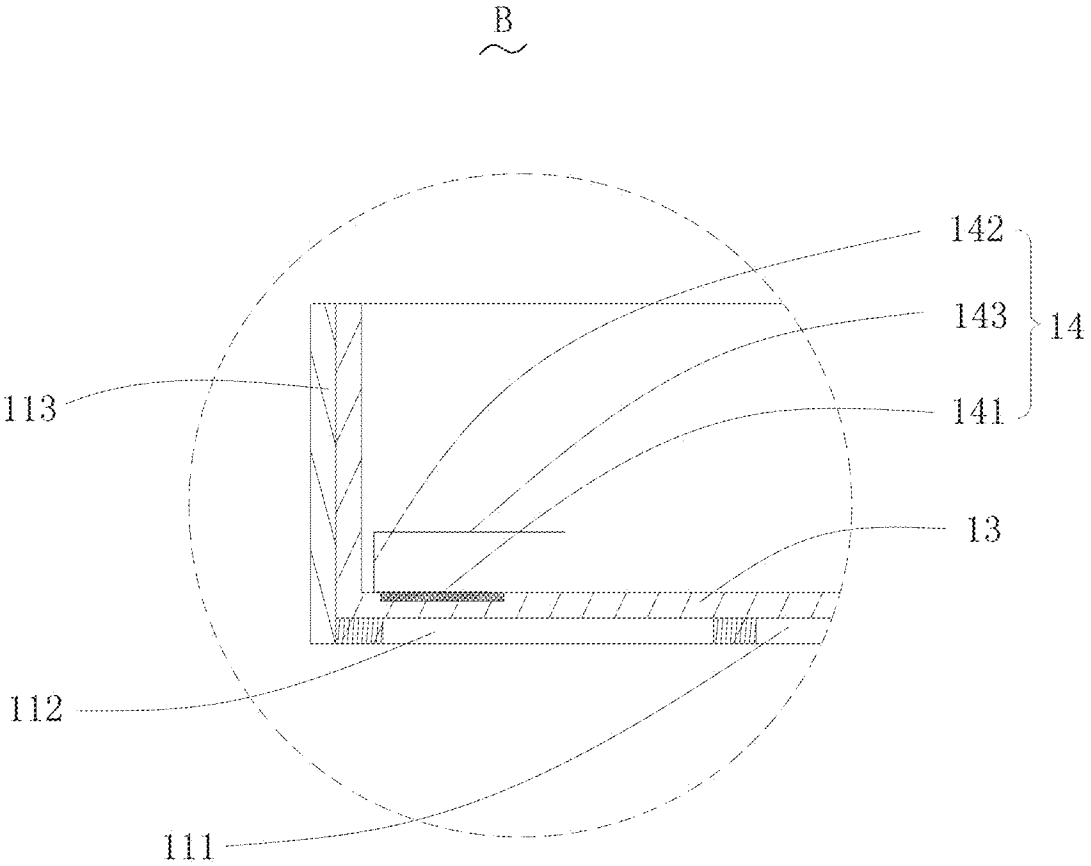
FIG. 5 is a partial enlarged view of portion B shown in FIG. 4.
Figure 6:
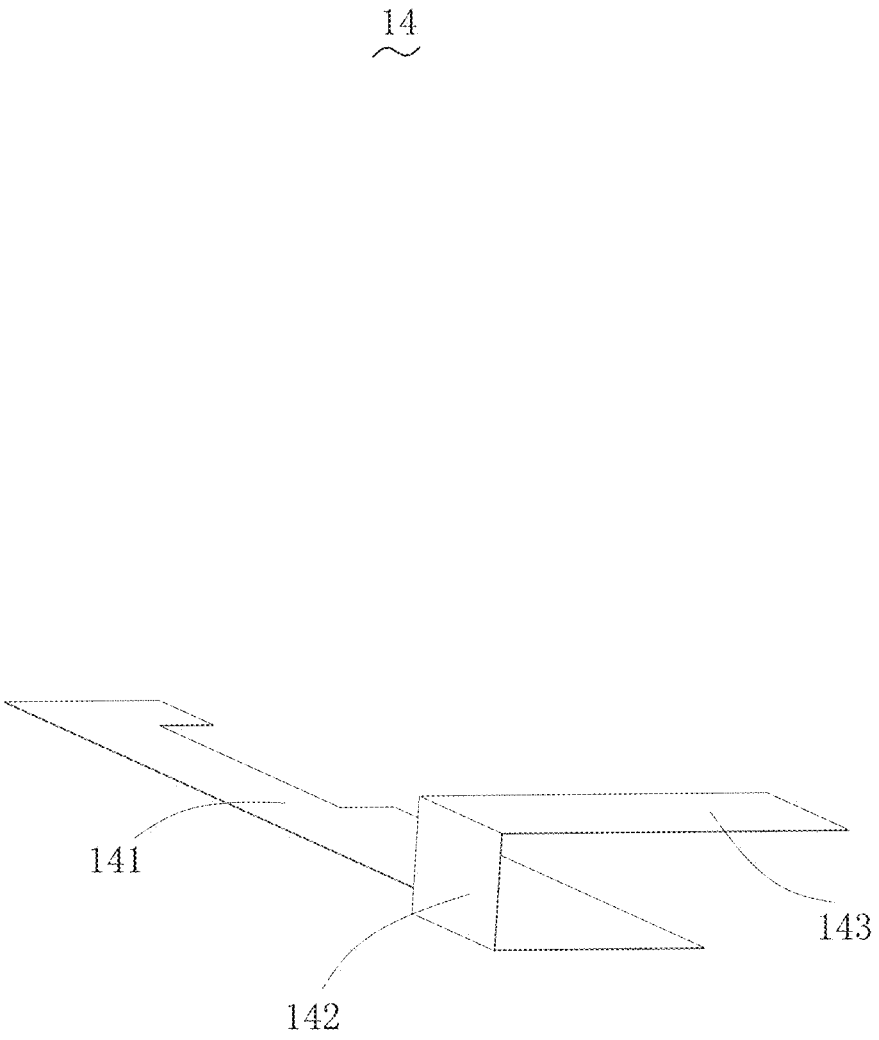
FIG. 6 is a structural schematic view of an LDS antenna shown in FIG. 1.

Please refer to FIG. 4, FIG. 5 and FIG. 6, FIG. 4 is a structural schematic view of a section along A-A line shown in FIG. 1; FIG. 5 is a partial enlarged view of portion B shown in FIG. 4; FIG. 6 is a structural schematic view of an LDS antenna shown in FIG. 1. The LDS antenna 14 is laser etched on the surface of the adhesive coated layer 13 and is coupled with the metal cover 112. Specifically, the LDS antenna 14 is laser etched on the modified region 131 and is coupled with the metal cover 112. The LDS antenna 14 includes a main portion 141, a first extending portion 142 extending from the main portion 141 and a second extending portion 143 extending from the first extending portion 142. The first extending portion 142 is perpendicularly connected with the main portion 141, the second extending portion 143 is arranged to be perpendicular to the first extending portion 142 and parallel to the main portion 141. The main portion 141 is coupled with the metal cover 112, the first extending portion 122 is coupled with the metal ring 113. The LDS antenna 14 is coupled with the metal cover 112 and the metal ring 113 so as to form an antenna, configured to receive and transmit radio wave. The LDS antenna 12 is directly installed on the inner wall of the adhesive coated layer 13 of the metal cover 112, the gap size between the LDS antenna 12 and the metal cover 112 can be controlled with the minimum tolerance (±0.05 mm) of the acceptable thickness size of the adhesive coated layer 13, so that the coupled antennas show better performance and consistency. Meanwhile the LDS antenna is coupled with the metal cover 112, so as to meet the requirements of the antenna on bandwidth, and the antenna performance is good.

Figure 7:
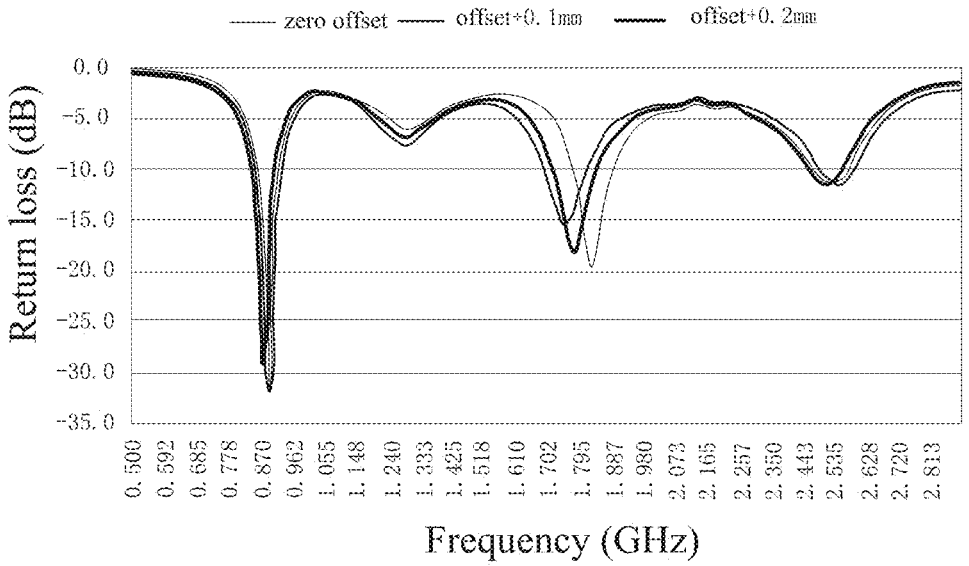
FIG. 7 is a view showing return loss of gap offset between an LDS antenna and an inner wall of an adhesive coated layer in an antenna device in accordance with the present disclosure.

Please refer to FIG. 7, which is a view showing return loss of gap offset between an LDS antenna and an inner wall of an adhesive coated layer in an antenna device in accordance with the present disclosure. "Zero offset" means that the LDS antenna 14 is completely fitted with the inner wall of the adhesive coated layer 13 of the metal housing 11 without a gap; "+" means that the gap size between the LDS antenna 14 and the inner wall of the adhesive coated layer 13 of the metal housing 11 increases. From the figure, it can be seen that, size change of the gap between the LDS antenna 14 and the inner wall of the adhesive coated layer 13 of the metal housing 11 only influences frequency bands of 824-960 MHz and 1710-2170 MHz, in particular frequency band of 1710-2170 MHz. Please refer to Table 1-1.

TABLE 1-1

Influence of gap size between LDS antenna and the inner wall of adhesive coated layer of the metal housing

| Frequency | Gap size difference | Frequency offset |
|---|---|---|
| 1710-2170 HZ | +0.1 mm | +20 MHz |
| | +0.2 mm | +60 MHz |

Figure 8:
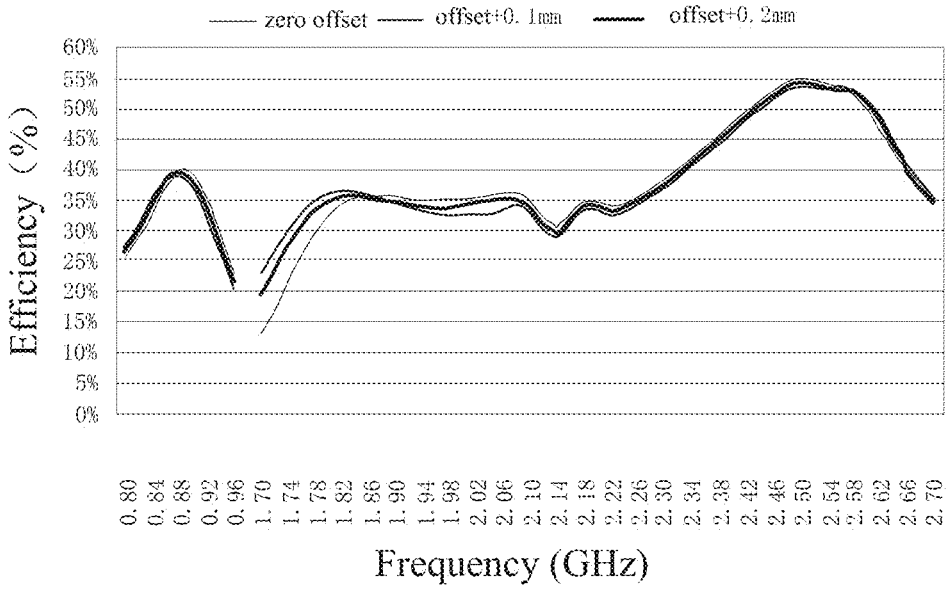
FIG. 8 is a view showing antenna efficiency of gap offset between an LDS antenna and an inner wall of an adhesive coated layer in an antenna device in accordance with the present disclosure.

Please refer to FIG. 8, which is a view showing antenna efficiency of gap offset between an LDS antenna and an inner wall of an adhesive coated layer in an antenna device in accordance with the present disclosure. Since the coupled antenna is sensitive to the gap size between two antennas, tiny difference in the gap size may result in dozens or hundreds MHz of frequency offset, which may lead to significant frequency offset difference between antennas, thereby restricting the application of coupled antenna in the cellphone. With reference to Table 1-2, for the above antenna, when the LDS antenna 14 is installed in the speaker box of the cellphone, the size of a gap between the speaker box and the metal back cover 112 is difficult to be controlled within 0.1 mm, which may result in large frequency offset difference among antennas, and thus design risk exists.

TABLE 1-2

Size tolerance when antenna installed in speaker box and on inner wall of adhesive coated layer of metal housing

| Process | Component | Tolerance size |
|---|---|---|
| LDS antenna installed on speaker box | Tolerance of adhesive coated layer | ±0.05 mm |
| | Tolerance of speaker box | ±0.1 mm |

TABLE 1-2-continued

Size tolerance when antenna installed in speaker box and on inner wall of adhesive coated layer of metal housing

| Process | Component | Tolerance size |
|---|---|---|
| | Assembling tolerance | ±0.15 mm |
| | Total tolerance | ±0.3 mm |
| LDS antenna installed on inner wall of adhesive coated layer | Tolerance of adhesive coated layer (total tolerance) | ±0.05 mm |

Figure 9:
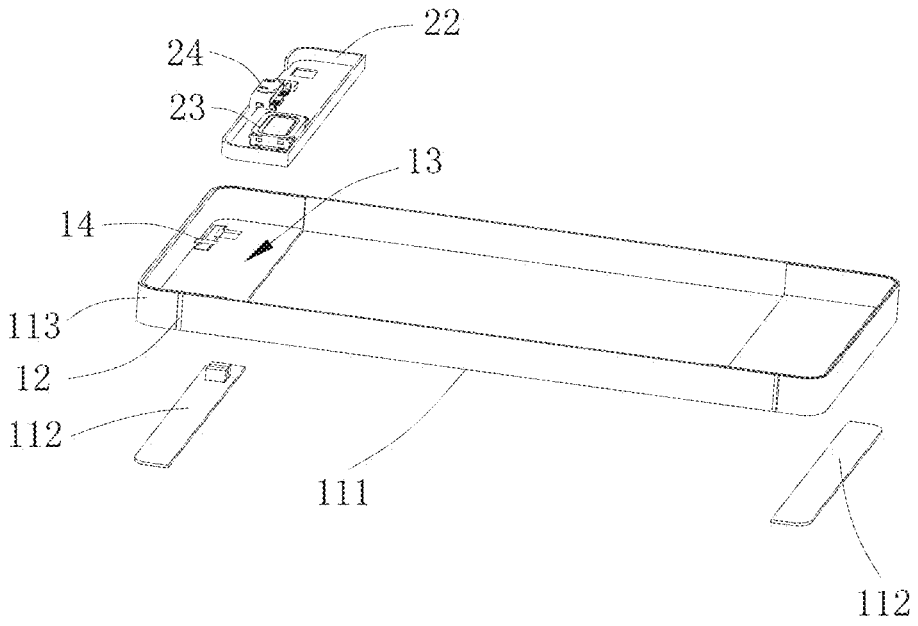
FIG. 9 is a structural schematic view of a mobile terminal adopting an antenna device in accordance with the present disclosure.

Please refer to FIG. 9, which is a structural schematic view of a mobile terminal adopting an antenna device in accordance with the present disclosure. The mobile terminal 2 includes a main board 22, a speaker 23 and a USB module 24 which are accommodated in the metal housing 11, the main board 22 is fitted on the adhesive coated layer 13, the speaker 23 is provided on the main board 22 and is electrically connected with the main board 22, the USB module 24 is fixed on the main board 22 and is electrically connected with the main board 22. The metal shell 111, the metal cover 112 and the metal ring 113 are connected via the connecting piece 12. The LDS antenna 14, the metal ring 113 and the metal cover 112 are the radiator of the antenna device 1, the LDS antenna 14, the metal ring 113 and the metal cover 112 are coupled to form an antenna. The LDS antenna 14 is installed on the adhesive coated layer 13 of the metal cover 112, and is coupled with the metal cover 112 and the metal ring 113, so that the gap size between the LDS antenna 14 and the metal cover 112 which serves as a radiator, the control precision is good, which can avoid frequency offset due to gap size caused by assembling error between antennas, so as to meet the requirements of the antenna on bandwidth, and the antenna shows better performance, meanwhile broadening the application range of coupled antennas in mobile terminal.

Comparing with the related art, in the antenna device of the present disclosure, through directly installing the LDS antenna on the inner wall of the adhesive coated layer of the metal cover, so that the gap size between the LDS antenna and the metal cover can be controlled with the minimum tolerance of the acceptable thickness size of the adhesive coated layer, so that the coupled antennas show better performance and consistency. Meanwhile the LDS antenna is coupled with the metal cover, so as to meet the requirements of the antenna on bandwidth, and broaden the application range of coupled antennas in mobile terminal.

It should be noted that, the above are merely embodiments of the present disclosure, those skilled in the art can make improvements without departing from the inventive concept of the present disclosure, however, these improvements shall belong to the protection scope of the present disclosure.

What is claimed is:

1. An antenna device, comprising:

a metal housing having accommodating space; and a laser direct structuring (LDS) antenna accommodated in the metal hosing, the metal housing comprises a metal shell, a metal cover and a metal ring which cooperate and are spaced with each other, wherein inner wall surfaces of the metal shell, the metal cover and the metal ring are respectively provided with an adhesive coated layer, the LDS antenna is laser etched on a surface of the adhesive coated layer and is coupled with the metal cover.

2. The antenna device as described in claim 1, wherein the adhesive coated layer comprises a modified region and a non-modified region surrounding a periphery of the modified region, the LDS antenna is laser etched on the modified region.

3. The antenna device as described in claim 2, wherein the modified region comprises a surface processing layer, a laser etching layer and a metal layer which are successively formed, the metal layer covers a surface of the laser etching layer, the laser etching layer is formed on the surface processing layer.

4. The antenna device as described in claim 1, wherein the LDS comprises a main portion, a first extending portion extending from the main portion and a second extending portion extending from the first extending portion, the main portion is coupled with the metal cover, the first extending portion is coupled with the metal ring.

5. The antenna device as described in claim 4, wherein the first extending portion is perpendicularly connected with the main portion, the second extending portion is arranged to be perpendicular to the first extending portion and parallel to the main portion.

6. The antenna device as described in claim 1, wherein the adhesive coated layer is a polybutylene terephthalate (PBT) layer.

7. The antenna device as described in claim 1, further comprising a connecting piece, the metal shell, the metal ring and the metal cover are connected via the connecting piece.

8. The antenna device as described in claim 7, wherein the connecting piece is integrated with the adhesive coated layer as a whole.

9. A mobile terminal device, wherein the mobile terminal device adopts the antenna device as described in claim 1.

* * * * *